US010315786B2

(12) United States Patent
Giuliani et al.

(10) Patent No.: US 10,315,786 B2
(45) Date of Patent: Jun. 11, 2019

(54) MACHINE FOR PROCESSING CONTAINERS HAVING AN IMPROVED CONTROL ARCHITECTURE

(71) Applicant: Sidel S.p.A. con SOCIO UNICO, Parma (IT)

(72) Inventors: Mattia Giuliani, Parma (IT); Mirko Rossi, Parma (IT); Andrea Forzenigo, Parma (IT)

(73) Assignee: SIDEL S.P.A CON SOCIO UNICO, Parma (IT)

( * ) Notice: Subject to any disclaimer, the term of this patent is extended or adjusted under 35 U.S.C. 154(b) by 835 days.

(21) Appl. No.: 14/585,461

(22) Filed: Dec. 30, 2014

(65) Prior Publication Data

US 2015/0183533 A1 Jul. 2, 2015

(30) Foreign Application Priority Data

Dec. 31, 2013 (EP) ..... 13199877

(51) Int. Cl.
*B65B 3/06* (2006.01)
*B65B 3/02* (2006.01)
(Continued)

(52) U.S. Cl.
CPC ..... *B65B 3/02* (2013.01); *B65B 3/06* (2013.01); *B65C 3/065* (2013.01); *B65C 3/26* (2013.01);
(Continued)

(58) Field of Classification Search
CPC ..... B65B 3/02; B65B 3/06; B67C 7/0006; B67C 7/0053; B67C 3/04; B67C 3/06;
(Continued)

(56) References Cited

U.S. PATENT DOCUMENTS 4,302,275 A * 11/1981 Burmeister ..... B29C 31/002 156/218
5,478,422 A * 12/1995 Bright ..... B65C 3/16 156/351
(Continued)

FOREIGN PATENT DOCUMENTS

CA 2023652 A1 * 2/1991 ..... B65C 3/26
DE 2241547 A1 3/1973
(Continued)

OTHER PUBLICATIONS

European Search Report in EP 13199877, dated May 15, 2014 (6 pages).

*Primary Examiner* — Andrew M Tecco
*Assistant Examiner* — Nicholas Igbokwe
(74) *Attorney, Agent, or Firm* — Finnegan, Henderson, Farabow, Garrett & Dunner LLP

(57) ABSTRACT

A machine for processing containers is disclosed. The machine has a conveying device and at least one processing unit coupled to the conveying device to be carried along a processing path. The processing unit is provided with: a winding element, having an outer lateral surface designed to receive, and cause winding of, a portion of labelling material in a tubular configuration with opposite ends overlapped, and a top surface designed to support a bottom portion of a container to be processed; a sealing device including a sealing element having a functional surface adapted to cooperate with said portion wound about said winding body for performing a welding process of the overlapped ends, as the processing unit is carried along the path, to form a sleeve label; and a displacement device, operable to cause a relative displacement between the sleeve label and the container.

20 Claims, 9 Drawing Sheets

(51) Int. Cl.

| | |
|---|---|
| ***B65C 3/06*** | (2006.01) |
| ***B65C 3/26*** | (2006.01) |
| ***B65C 9/40*** | (2006.01) |
| ***B67C 3/04*** | (2006.01) |
| ***B67C 3/06*** | (2006.01) |

(52) U.S. Cl.
CPC ..... *B65C 9/40* (2013.01); *B67C 3/04* (2013.01); *B67C 3/06* (2013.01)

(58) Field of Classification Search
CPC ..... B67C 3/02; B67C 3/007; B67C 2003/226; B65C 9/40; B65C 3/065; B65C 3/26; B65C 3/14; B65C 3/06; B65C 9/02; B65C 9/42
USPC ..... 53/282, 64, 66, 67, 167, 585, 588; 156/363, 364, 465, 466
See application file for complete search history.

(56) References Cited

U.S. PATENT DOCUMENTS 5,713,403 A * 2/1998 Clusserath ..... B65C 3/16 141/101
5,772,565 A * 6/1998 Weyandt ..... B29C 65/18 493/10
6,470,922 B2 * 10/2002 Sindermann ..... B67C 3/10 141/37
2002/0161467 A1 * 10/2002 Hashiguchi ..... G05B 23/0229 700/116
2002/0170269 A1 * 11/2002 Liao ..... B29C 65/18 53/374.6
2004/0099379 A1 * 5/2004 Erich ..... B65C 9/00 156/567
2006/0037706 A1 * 2/2006 Putzer ..... B65C 9/06 156/360
2008/0083504 A1 * 4/2008 Zacche ..... B65C 9/04 156/378
2009/0255214 A1 * 10/2009 Schussler ..... B67B 3/2086 53/331.5
2011/0094195 A1 * 4/2011 Bartoli ..... B26D 1/205 53/558
2011/0186236 A1 * 8/2011 Pace ..... B29C 53/44 156/538
2012/0227897 A1 * 9/2012 Pace ..... B29C 53/44 156/215
2013/0307197 A1 * 11/2013 Haesendonckx ..... B29C 49/46 264/524

FOREIGN PATENT DOCUMENTS

| | | | |
|---|---|---|---|
| EP | 0414031 | A1 | 2/1991 |
| EP | 2610189 | A1 | 7/2013 |
| EP | 2626312 | A1 | 8/2013 |
| WO | WO 2011/018807 | A1 | 2/2011 |
| WO | WO 2011/061092 | A1 | 5/2011 |

* cited by examiner

MACHINE FOR PROCESSING CONTAINERS HAVING AN IMPROVED CONTROL ARCHITECTURE

CROSS-REFERENCE TO RELATED APPLICATIONS

This application claims the benefit of priority of European Patent Application No. 13199877.5, filed Dec. 31, 2013, which is incorporated herein by reference.

The present invention relates to a container processing machine, designed to perform labelling operations in the context of filling and packaging of containers for pourable products, such as carbonated liquids, like sparkling water, soft drinks or beer.

In particular the present solution may be implemented for any type of container, such as containers or bottles made of glass, plastics, aluminum, steel and composites, and for any type of pourable product, such as carbonated or non-carbonated liquids (including still water, juices, teas, sport drinks, liquid cleaners, wine, etc), emulsions, suspensions and high viscosity liquids.

BACKGROUND OF THE INVENTION

As is known, pourable products are sold in a wide range of bottles or containers, which are sterilized, filled and capped in container processing plants, typically including a plurality of processing stations or machines, such as rinsing machines, filling machines, labelling machines and capping machines. These processing stations may include linear machines or, more frequently, rotating, or so called "carousel-type", machines.

The following description will refer to rotating or carousel-type machines only, although this is in no way intended to limit the scope of the present application.

Labelling machines are known, which are designed to apply labels on the containers being processed.

In particular, sleeve labels are often used with bottles or other containers designed to contain pourable products; such labels are obtained by the subsequent steps of: cutting a web, unwound, from a supply roll, into a plurality of web portions, e.g. of a rectangular or square shape; winding each web portion in a tubular configuration so that opposite vertical edges overlap; and welding or sealing of the overlapping edges to fix the web in a sleeve form.

Labelling machines are known, in which each sleeve label, is formed about a cylindrical winding body (commonly known as "sleeve drum") end subsequently transferred onto a container, by introduction of the container within the sleeve label. The sleeve label is then fixed on the container by means of a thermal retraction process.

This kind of labelling machine comprises a conveyor (so called carousel), which rotates about a vertical axis defining a substantially circular path, along which it is designed to: receive respective sequences of unlabelled containers and of labelling material portions from respective input wheels; manage the application of sleeve labels onto corresponding containers; and release the labelled containers onto an output wheel.

The carousel comprises a number of processing units which are equally spaced about the rotation axis, are mounted along the periphery of the carousel and are moved by the latter along the above-mentioned circular path.

Each processing unit comprises a supporting element, which is designed to support the bottom wall of a container, and a retaining element, which is designed to engage the top portion of the container to maintain it in a vertical position during the rotation of the carousel.

As schematically shown in FIG. 1*a*, each supporting element 1 comprises a base 2, fixed to a horizontal plane of a rotating frame of the carousel, and a cylindrical winding body 3, which is coupled to the base 2 and is designed to carry a respective container 4 on a top surface thereof, and a respective sleeve label 5 on a side surface thereof.

Winding body 3 is movable, by mechanical cam means (not shown), between a raised position and a completely retracted position, with respect to the base 2.

In the raised position (shown in FIG. 1*a*), winding body 3 is adapted to receive sleeve label 5 on its side surface from a label input wheel; in particular, sleeve label 5 is wound about the winding body 3, so that opposite vertical edges thereof are overlapped to one another.

After welding of the overlapped edges of the sleeve label 5 by a sealing device, the movement of the winding body 3 from the raised position to the completely retracted position determines the insertion of the container 4 within the sleeve label 5 (as indicated by the arrow in FIG. 1*b*); the container obtained thereby is ready to be transferred onto the output wheel.

Although satisfactory with respect to many aspects, the Applicant has realized that this known solution also suffers from some drawbacks.

In particular, control of the machine requires a number of control units, designed to manage operation of the various operating elements, and the various control units need to be communicatively coupled, in order to manage processing of the containers.

Moreover, designing of the mechanical cam means, which cause movement of the containers 4 within the sleeve labels 5, may be a critical aspect of the overall machine design.

In general, it is also known that it may prove desirable to integrate more functions within a single multi-purpose machine, in order to simplify design and layout, of the container processing plant and also improve maintenance thereof.

However, the above discussed solution is not altogether satisfactory in this respect; in particular, the labelling operation may impede execution of further operations, such as filling operations relating to the same containers 3.

Therefore, the need is surely felt for a solution, which may improve designing of layout and control architecture of container processing machines, in particular with respect to labelling and associated processing operations.

SUMMARY OF THE INVENTION

It is an object of the present invention to solve, at least in part, the problems previously highlighted and to satisfy, at least in part, the above need.

According to an aspect the present invention a machine for labelling containers is thus provided, as defined in the appended claims.

BRIEF DESCRIPTION OF THE DRAWINGS

For a better understanding of the present invention, preferred embodiments thereof will now be disclosed by way of non-limitative example and with reference to the accompanying drawings, in which.

DETAILED DESCRIPTION OF THE INVENTION

Figure 1A:
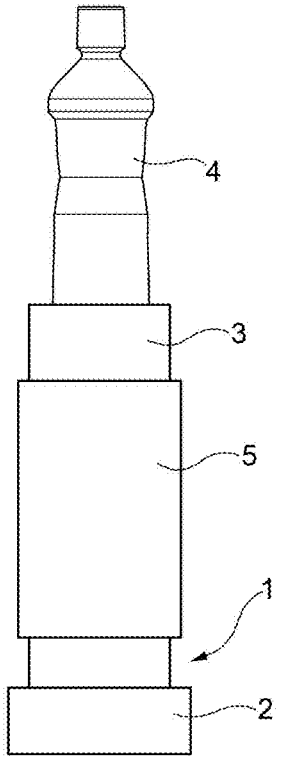
FIGS. 1*a*-1*b* schematically show a known solution to cause a relative displacement of a container with respect to a sleeve label in a container processing machine, in respective operating conditions.
Figure 1B:
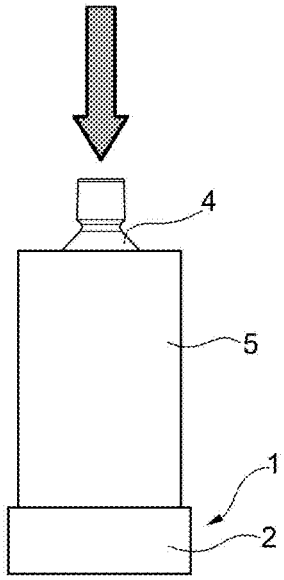
Figure 2:
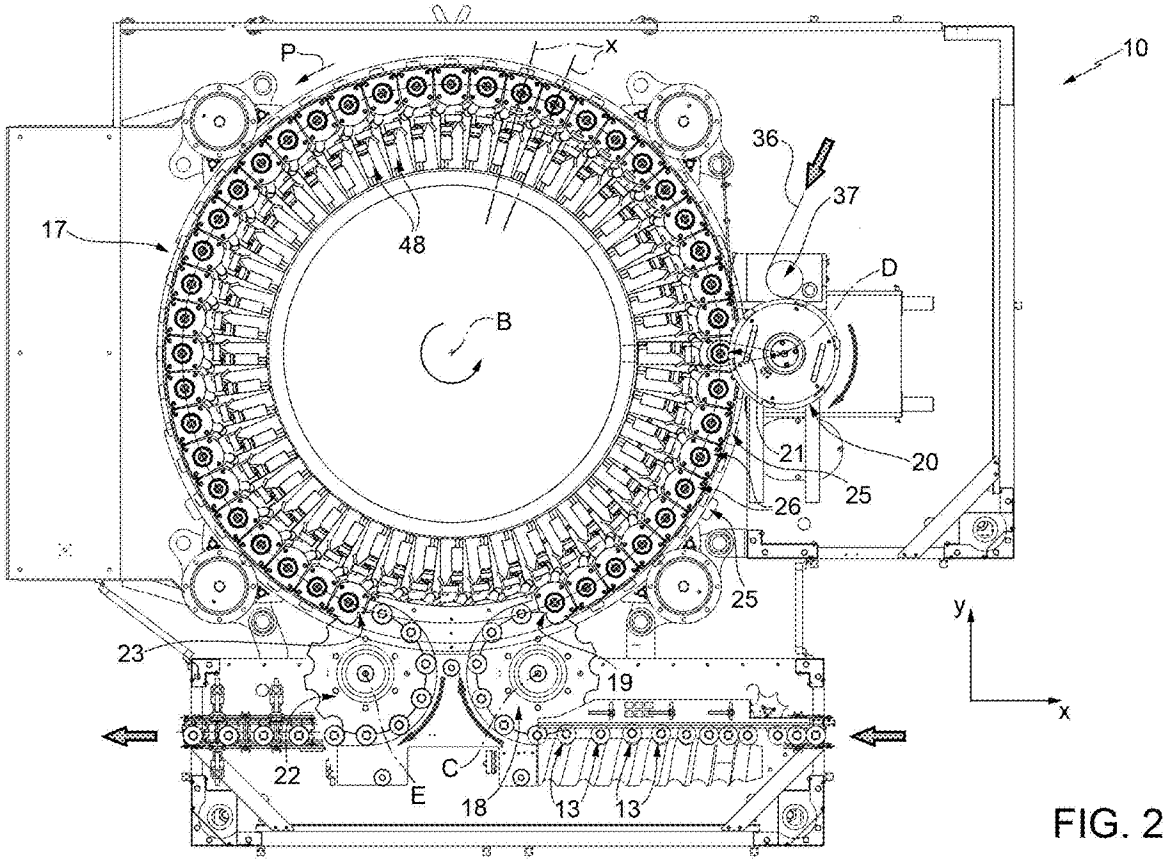
FIG. 2 shows a diagrammatic plan view of a container processing machine, according to an embodiment of the present solution.

FIG. 2 shows a machine for processing containers, of the rotating type, indicated in general with 10, which is configured to carry out labelling operations, so as to apply sleeve labels, again denoted with 5, (see also FIGS. 3-5 and FIGS. 6*a*-6*b*) on respective containers, in the example bottles, here denoted with 13.

Each container 13 has a longitudinal axis A, has a bottom wall 14 substantially perpendicular to axis A, and a top neck 15 substantially coaxial with axis A.

Machine 10 comprises a conveying device, including a conveyor (or carousel) 17, which is mounted to continuously rotate (in an anticlockwise direction in FIG. 3) about a vertical axis B perpendicular to a horizontal plane xy (the plane of FIG. 2).

Conveyor 17 receives a sequence of unlabelled containers 13, from an input, wheel 18, which cooperates with conveyor 17 at a first, transfer station 19 and is mounted to continuously rotate about a respective longitudinal axis C parallel to axis B.

Conveyor 17 also receives a sequence of portions, for example rectangular or square-shaped portions, of a labelling web material (for example of a plastic film) from an input drum 20, which cooperates with conveyor 17 at a second transfer station 21 and is mounted to continuously rotate about a respective longitudinal axis D parallel to axes B and C.

Conveyor 17 releases a sequence of labelled containers 13 onto an output wheel 22, which cooperates with conveyor 17 at a third transfer station 23 and is mounted to continuously rotate about a respective longitudinal axis E parallel to axes B, C and D.

Conveyor 17 carries a number of processing units 25, which are equally spaced about axis B and are mounted on the periphery of conveyor 17; processing units 25 are displaced by the same conveyor 17 along a substantially circular path P, which extends about axis B and through transfer stations 19, 21 and 23.

Figure 4:
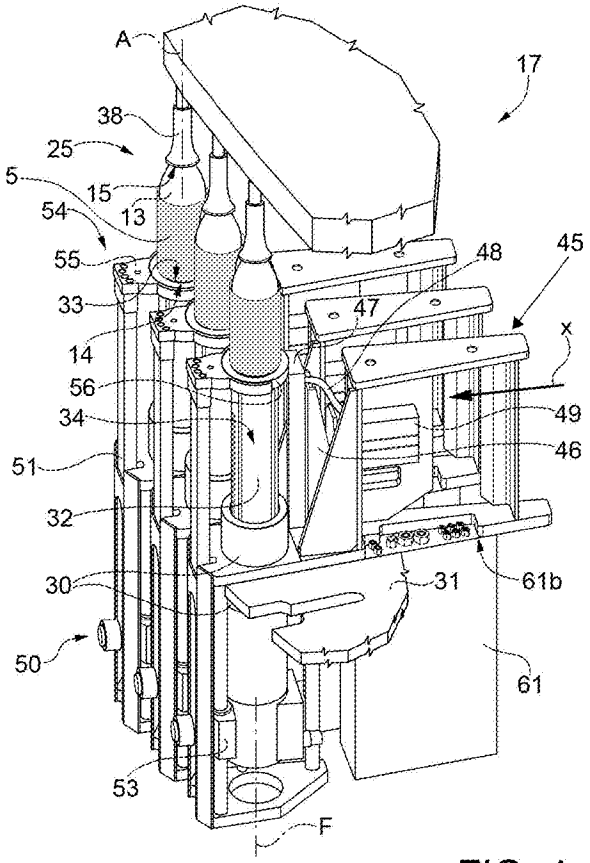
FIGS. 3 and 4 show schematic perspective views, at an enlarged scale, of a portion of the processing machine of FIG. 2, in respective operating conditions.
Figure 3:
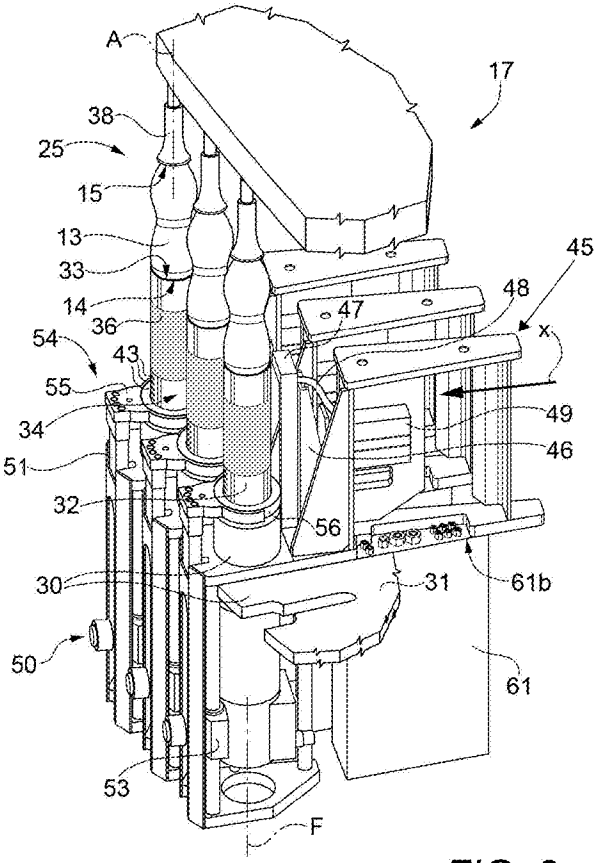
Figure 5:
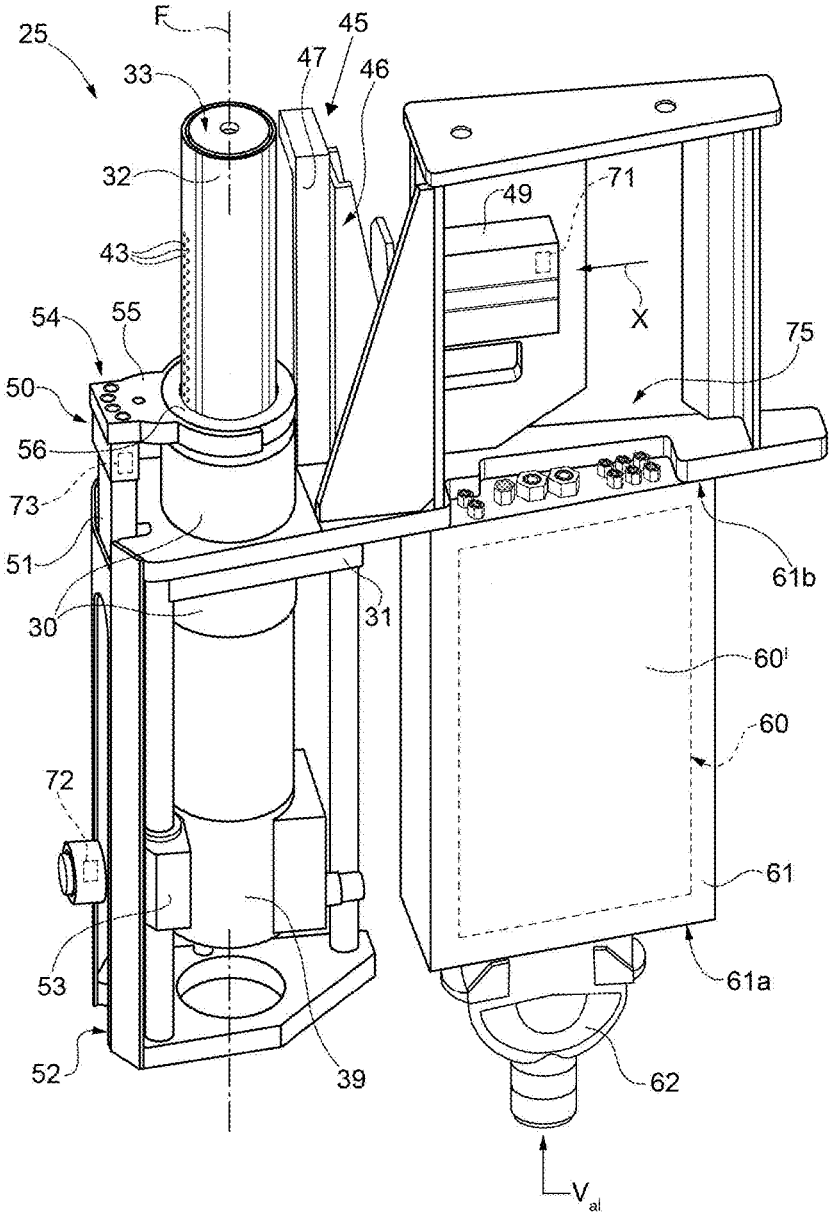
FIG. 5 shows a schematic perspective view, at an enlarged scale, of a further portion of processing machine of FIG. 2.

With particular reference to FIGS. 3 to 5, each processing unit 25 is designed to receive a respective container 13 from input wheel 18 in a vertical position, i.e. with relative axis A parallel to axes B, C, D and E, and to maintain container 13 in this position along path P from transfer station 19 up to transfer station 23.

Each processing unit 25 comprises:

a base 30, which is fixed onto a plane or a horizontal table of a rotating frame 31 of conveyor 17;

a substantially cylindrical winding body 32, which is coupled to base 30, has a vertical axis F, parallel to axes B, C, D and E, and is designed to coaxially carry bottom wall 14 of a respective container 13 on a top surface 33 and a portion of labelling material, here designated with 36, on a side surface thereof; in particular, a receptive unlabelled container 13 is transferred from transfer station 19 to top surface 33 of winding body 32, and labelled container 13 is transferred from the same top surface 33 of winding body 32 to transfer station 23; and a top retaining element 38 designed to engage top neck 15 of container 13, to contribute maintaining the same container 13 in a vertical position.

In particular, each winding body 32 can be rotated about vertical axis F under the control of an electric motor 39 (see in particular FIG. 5), which is coupled to the base 30 of the respective processing unit 25, under the plane of the rotating frame 31.

Each winding body 32 projects from the base 30 and is designed to receive, on its side surface 34, the portion 36 of labelling material from input dram 20. More specifically, the portions 36 of labelling material are cut from a labelling web material by means of a cutting device 37 (schematically shown in FIG. 2) and fed to input drum 20 to be transferred onto winding bodies 32.

The cut portions 36 of labelling material are retained on the side surface 34 of each winding body 32 by a vacuum suction action. Indeed, side surface 34 of winding body 32 is provided with a plurality of through-holes 43, coupled to a pneumatic suction device (of a known type, here not shown), so as to retain in place the respective portion 36 of labelling material, by suction.

At transfer station 21, each winding body 32 is rotated about axis F under the control of the respective electric motor 39, in order to perform the complete winding of the respective cut portion 36 of labelling material, coming from input drum 20, on its side surface 34, so as to form a substantially tubular sleeve with opposite ends overlapped.

Each processing unit 25 further comprises a respective sealing device 45 arranged in front of, and in a position radially internal with respect to, a respective winding body 32; each sealing device 45 cooperates with the cut portion 36 of labelling material wound about corresponding winding body 32 for welding relative overlapped ends so as to create a sleeve label 5, which will then be arranged about container 13.

Each sealing device 45 comprises a heating element 46, designed to cause wielding of the overlapped ends by heating thereof.

In a possible embodiment, heating element 46 includes a rectilinear bar 47, having an extension at least equal to the height of the overlapped ends to be welded of portion 36 of labelling material, and having an active functional surface, which is resistively heated and positioned in contact with the material to be welded, or sealed. Rectilinear bar 47 defines therein a cooling duct (not shown), designed to receive a cooling fluid, from tubes 48, for example water coming from a refrigerator unit (here not shown).

During operation, the active functional surface of rectilinear bar 47 is supplied by means of electric wires connected thereto by a power supplying module, which provides current pulses for generating short heating pulses (on the order of a few hundreds of milliseconds) having controllable temperature and duration. Cooling through cooling duct allows to maintain rectilinear bar 47 at a substantially constant temperature, increasing thereby the efficiency of the heating and welding process.

Sealing device 45 further includes a first actuator element 49, for example of the linear pneumatic type, configured so as to displace heating element 46 towards, and from, overlapped edges of respective portion 36 of labelling material, along a direction X transversal to the portion of path P.

As shown in FIG. 2, directions X, along which sealing devices 45 are displaced, extend radially with respect to axis B, and orthogonally to axes B-F.

According to a particular aspect of the present solution, each processing unit 25 further comprises a respective displacement device 50, coupled to winding body 32, and designed to cause a vertical displacement of sleeve label 5 along the same winding body 32 in the direction of vertical axis F.

In detail, displacement device 50 includes:

a vertical arm 51, which is designed to slide within a guide 52, aligned to vertical axis F and coupled to rotating frame 31;

a second actuator element 53, for example of the linear pneumatic type, configured to displace vertical arm 51 along the guide 52; and a displacement unit 54, carried by the vertical arm 51, at a free end thereof, and configured to interact with sleeve label 5 to cause displacement thereof.

According to a possible embodiment, displacement unit 54 includes: a gripping element 55, for example in the form of a pliers, coupled to the vertical arm 51; and a ring platform 56, arranged about the winding body 32 and coupled to the gripping element 55.

Figure 6A:
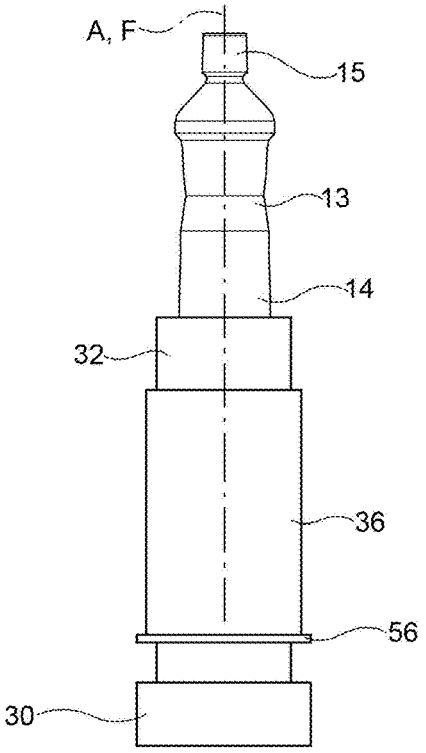
FIGS. 6*a*-6*b* schematically show a solution to cause a relative displacement of a container with respect to a sleeve label in the processing machine of FIG. 2, in respective operating conditions.
Figure 6B:
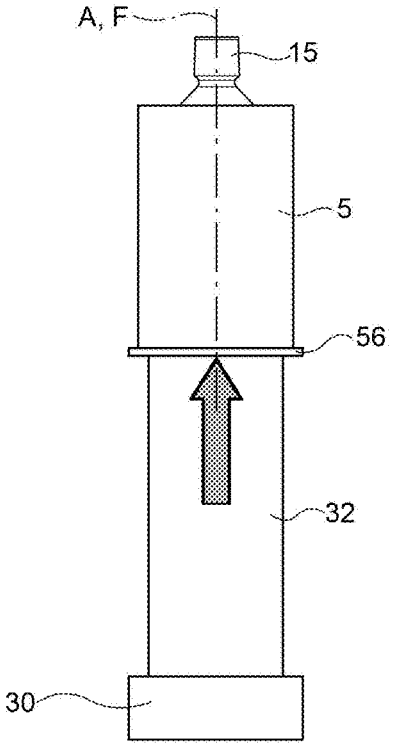

As schematically shown also in FIGS. 6*a* and 6*b*, displacement device 50 is configured to cause displacement of the displacement unit 54 from a first, "down" or retracted, position (shown in FIG. 6*a* and in FIG. 3), in which the ring platform 56 is arranged at the base 30, towards a second, "up" or extended, position (shown in FIG. 6*b* and in FIG. 4), in which the ring platform 56 is arranged at the top surface 33 of winding body 32.

Displacement of displacement unit 54 from the first to the second position causes sleeve label 5 to be carried by ring platform 56 towards container 13, which is placed on top surface 33 of winding body 32; in particular, at the second position, sleeve label 5 is brought around a desired portion of container 13 (generally, this portion being not flat and cylindrical, but having an irregular outer surface).

In this position, sleeve label 5 is then adhered to the outer surface of container 13, by means of a thermal shrinking process. It is noted, that a diameter of winding body 32 (and of label 5) is higher than the diameter of the portion of the container 13 where the same label 5 is to be applied, so as to allow the above thermal shrinking process.

According to a further aspect of the present solution, each processing unit 25 comprises a respective control circuit 60, which is arranged within a case 61, carried by rotating frame 31 of conveyor 17, at a radially internal position with respect to winding body 32.

Case 61 has a bottom portion 61*a* carrying a power supply connection 62, designed to receive an input power supply signal $V_{a1}$ from an external power supply unit, and a top portion 61*b*, opposite to bottom portion 61*a* with respect to axis F and arranged at the rotating frame 31. Top portion 61*b* carries a plurality of connectors, generally denoted with 75, designed to couple to respective sensors and actuators, as will be disclosed in detail in the following.

In particular, control circuit 60 is configured to jointly control; first actuator element 49, so as to cause displacement of heating element 46 towards, and from, the respective portion 36 of labelling material, in order to seal the overlapping edges thereof; and second actuator element 53, so as to cause displacement of sleeve label 5 in the vertical direction towards container 13.

Control circuit 60 is moreover configured to provide power supply signals to heating element 46, in a selective and controlled manner, and moreover to communicate with an external supervising unit of labelling machine 10 (and possibly of further machines, or parts thereof, cooperating with processing machine 10 in the container processing plant), in particular including a Programmable Logic Controller (PLC) unit.

Accordingly, control circuit board 60 defines a unique and centralized control center for the respective processing unit 25, designed to control whole operation thereof and particularly (as will be discussed later on) timing and sequence of the various operating phases of sealing device 45 and of displacement device 50.

Figure 7:
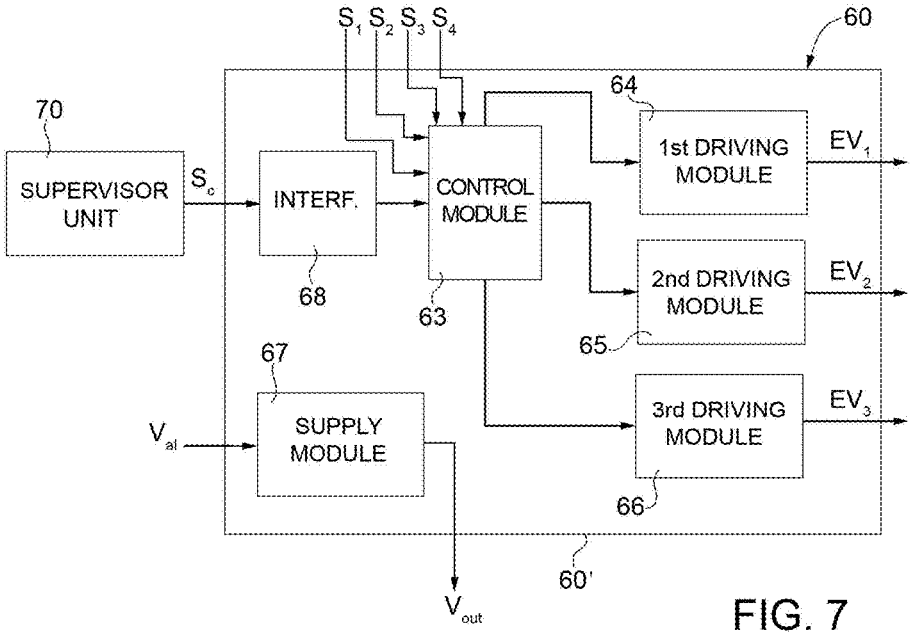
FIG. 7 is a schematic block diagram of a control circuit of processing machine of FIG. 2.

In more detail, and as schematically shown in FIG. 7, control circuit 60 includes the following modules, which are conveniently all integrated in a same printed circuit board 60' within case 61:

a control module 63, provided with a processing element (such as a microprocessor, a microcontroller, a DSP—Digital Signal Processor, or similar digital processing element);

a first driving module 64, configured to drive the first actuator element 49 in order to cause displacement of heating element 46 of sealing device 45 towards, and from, the respective portion 36 of labelling material; for example, first driving module 64 provides a first driving signal $EV_1$ to a first electrovalve (not shown), coupled to first actuator element 49;

a second driving module 65, configured to drive the second actuator element 53 in order to cause displacement of vertical arm 51 of displacement device 50 along the guide 52; for example, second driving module 65 provides a second driving signal $EV_2$ to a second electrovalve (not shown), coupled to second actuator element 53;

a third driving module 66, configured to activate the vacuum suction action of the pneumatic suction device coupled to winding body 32, so as to retain in place the portion 36 of labelling material, wound about the same winding body 32; for example, third driving module 66 provides a third driving signal $EV_3$ no a third electrovalve (not shown), coupled to the pneumatic suction device;

a power supply module 67, configured to provide output power supply signals $V_{out}$ to the heating element 47 of the respective sealing device 45, generated starting from the input power supply signal $V_{a1}$, so as to cause heating thereof during the sealing, or welding, operation; and an interface module 68, configured to receive suitable control signals, indicated with $S_c$, from supervising unit, here denoted with 70, of processing machine 10.

Control module 63 receives feedback signals from, a number of sensors coupled to processing unit 25, and in particular:

a first feedback signal $S_1$ from a first position sensor 71 (schematically shown in FIG. 5), coupled to heating element 46; the first feedback signal $S_1$ is indicative of displacement of the heating element 46 towards, and from, the respective portion 36 of labelling material;

a second feedback signal $S_2$ from a second position sensor 72 (schematically shown in FIG. 5), coupled to displacement device 50; the second feedback signal $S_2$ is indicative of displacement of displacement unit 54 to the first position ("down position");

a third feedback signal $S_3$ from a third position sensor 73 (schematically shown in FIG. 5), coupled to displacement device 50; the third feedback signal $S_3$ is indicative of displacement of displacement unit 54 to the second position ("up position"); and a fourth feedback signal $S_4$ from a fourth position sensor (not shown), of the encoder type, coupled to the rotating frame 31 of conveyor 17; the fourth feedback signal $S_4$ is indicative of a rotation angle of conveyor around axis B.

Figure 8:
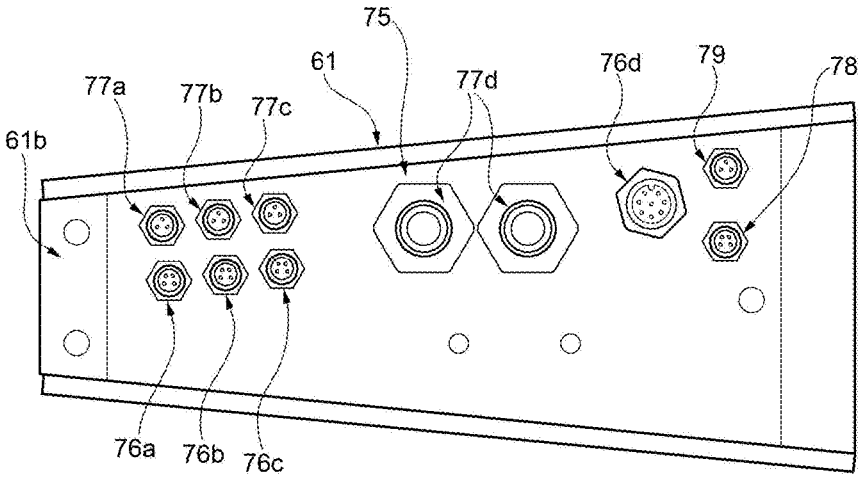
FIG. 8 is a schematic top plan view of a case housing a circuit board for control circuit of FIG. 7.

As also shown in FIG. 8, top portion 61*b* of case 61 carries a number of connectors 75, for inputting and outputting input and output signals managed by the control circuit 60, and in particular:

first, second, third and fourth input, connectors 76*a*-76*d*, designed, to receive feedback signals $S_1$-$S_4$ from the above defined position sensors;

first, second, third and fourth output connectors 77*a*-77*d*, designed so provide driving signals $EV_1$-$EV_3$ and the generated output power supply signals $V_{out}$; and a communication connector 78, designed to receive control signals $S_c$ from supervising unit 70, e.g. via a data communication bus.

Top portion 61*b* of case 61 may also carry a status LED 79 (Light Emitting Diode), operable by control module 63 to show an operating status of processing unit 25.

In a manner not shown, case 61 may also define internal passages for cooling and vacuum fluids, as required during the operating phases of the labelling process.

During operation, control module 63, based on feedback signals $S_1$-$S_4$ received from position sensors and based on control signals $S_c$ received from supervising unit 70 is able to control the whole labelling operation, including a number of operating phases, which are defined by a suitable timing and pattern of the generated driving signals $EV_1$-$EV_3$ and of the generated, output power supply signals $V_{out}$.

Figure 9:
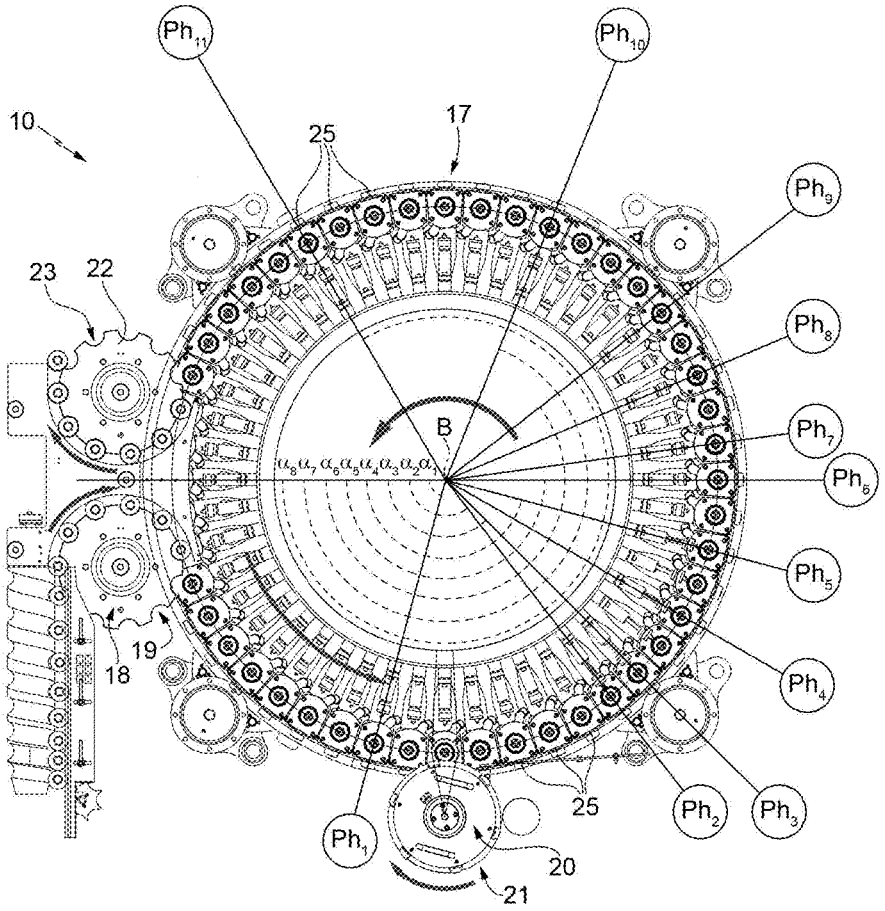
FIG. 9 is a view analogous to that of FIG. 2, diagrammatically showing different operating phases associated to processing machine.
Figure 10:
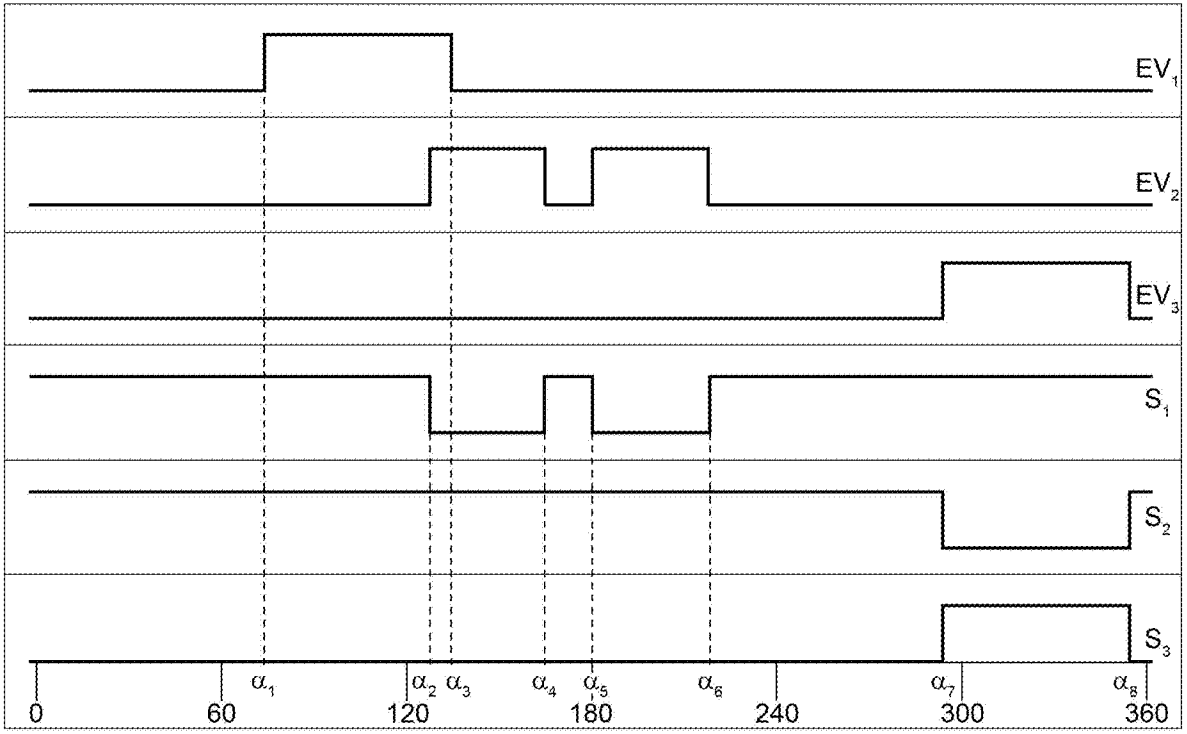
FIG. 10 shows plots of electrical signals associated to the operating phases of processing machine shown in FIG. 9.

According to a possible embodiment, which is schematically represented in FIGS. 9 and 10, the labelling operation on each container 13 is implemented through a sequence of operating phases, each executed at a corresponding rotation angle of conveyor 17 (and consequently of the respective processing unit 25) about axis B, starting from arrival of the container 13 to be processed at first transfer station 19 (as shown in FIG. 9); each operating phase is defined by corresponding values of feedback signals $S_1$-$S_4$ and of driving signals $EV_1$-$EV_3$.

In detail, in a possible embodiment, the labelling operation may include the following operating phases:

a first operating phase, denoted with $Ph_1$ in FIG. 9, carried out starting from an angle $\alpha_1$, before container 13 reaches input drum 20, during which control module 63 activates the vacuum suction action at the winding body 32; during this first operating phase, the portion 36 of labelling material received from input drum 20 is wound around winding body 32;

a second operating phase, denoted with $Ph_2$, carried out starting from an angle $\alpha_2$, at which control module 63 causes displacement of heating element 46 towards the portion 36 of labelling material wound about winding body 32;

a third operating phase, denoted with $Ph_3$, carried out starting from an angle $\alpha_3$, at which control module 63 deactivates the vacuum suction action at the winding body 32 and activates the welding action by supplying output power supply signals $V_{out}$ to the heating element 46, thus causing welding of the overlapped edges of the portion 36 of labelling material and formation of sleeve label 5;

a fourth operating phase, carried out at a rotation angle higher than angle $\alpha_3$, denoted with $Ph_4$, at which control module 63 stops the welding action and activates cooling through the heating element 46, by causing cooling fluid to flow through cooling duct of rectilinear bar 47 of the same heating element;

a fifth operating phase, denoted with $Ph_5$, carried out starting from an angle $\alpha_4$, at which control module 63 causes displacement of heating element 46 backwards with respect to the sleeve label 5;

a sixth operating phase, denoted with $Ph_6$, carried out starting from an angle $\alpha_5$, at which control module 63 causes again displacement of heating element 46 towards sleeve label 5 and also deactivates the cooling action;

a seventh operating phase, denoted with $Ph_7$, carried oat at a rotation angle higher than angle $\alpha_5$, at which control module 63 activates again the welding action by supplying power supply signals $V_{out}$ to the heating element 46;

an eight operating phase, denoted with $Ph_8$, carried out at a rotation angle higher than the respective rotation angle of the seventh operating phase, at which control module 63 stops the welding action and activates cooling through the heating element 46;

a ninth operating phase, denoted with $Ph_9$, carried out starting from an angle $\alpha_6$, at which control module 63 causes displacement of heating element 46 backwards with respect to the sleeve label 5 and moreover stops cooling through the heating element 46;

a tenth operating phase, denoted with $Ph_{10}$, carried out starting from an angle $\alpha_7$, at which control module 63 activates second actuator element 53 in order to cause displacement of displacement device 50 along the guide 52 and to lift displacement unit 54 from the retracted to the raised position, thereby carrying the sleeve label 5 towards the container 13; and an eleventh operating phase, denoted with $Ph_{11}$, carried out starting from an angle $\alpha_8$ (after the thermal shrinking action to adhere the sleeve label 5 to the container 13 has been performed), at which control module 63 activates second actuator element 53 in order to cause displacement of displacement device 50 and bring back displacement unit 54 to the retracted position.

As shown in FIG. 10, in the discussed example, driving signals $EV_1$-$EV_3$ are brought by the control module 63 either to a high or to a low value, based on the control action to be performed; feedback signals $S_1$-$S_3$ have corresponding values, which again may be of a high or a low value.

According to a possible embodiment, which is based on the solution disclosed in detail in WO 2011/179272 A1, filed by the present Applicant (to which reference is made herein), power supply modules 67 of heating elements 46 in the processing units 25 of machine 10 receive appropriate power supply signals from a converting circuit, which is single for the whole machine 10 (and thus provides power to all power supply modules 67).

Converting circuit comprises a three-phase insulating converter, having three primary windings, each connected to a respective phase of a three-phase power supply network of the electric system of the processing plant, providing for example a voltage having a maximum peak value of 400 V, and at least one secondary winding. The three-phase insulating converter has a power sufficient to supply all heating elements 47 of machine 10 active at the same time during welding operations.

Converting circuit provides suitably converted DC voltages to power supply modules 67 and is arranged at a distance, externally to the rotating part of machine 10, for example in a main transformer room or control box thereof.

Each power supply module 67 forms a high efficiency resonant converter, capable of supplying the respective heating element 46 with a quasi-sinusoidal current at a high frequency (much higher than that of the power supply network), for example of 200 kHz, and an appropriate peak power, for example in the range between 2.5 and 3 kW.

Power supply module 67 comprises a resonant, power circuit including a bridge inverter and a LC network, including a resonance capacitor and a resonance inductor, forming the primary winding of an output transformer, which provides output power supply voltage $V_{out}$. A resistive feedback sensor provides a measure of the current (and indirectly of the power) absorbed by heating element 46, as a feedback towards control module 63, in order to maintain the power level constant, even upon variation of the operating conditions, for example due to a deterioration of the same heating element 46.

Figure 11:
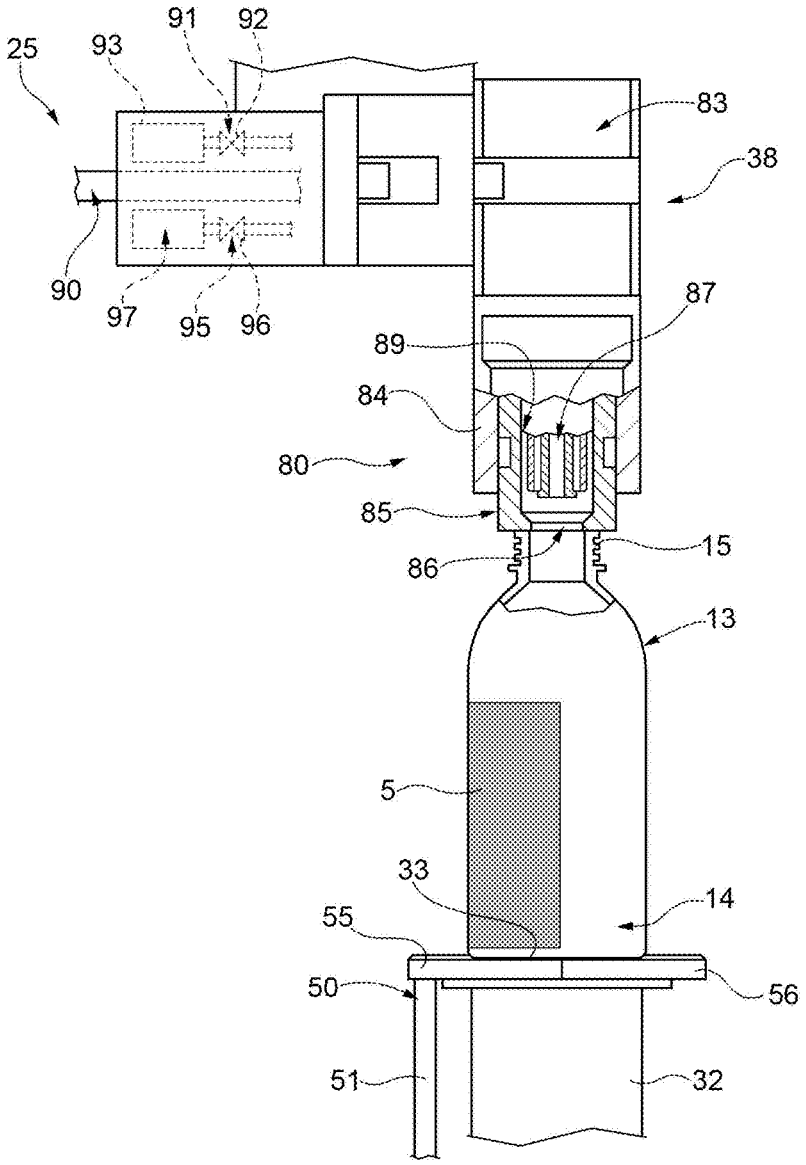
FIG. 11 shows a schematic side view, at an enlarged scale, of a further portion of processing machine of FIG. 2, according to a further embodiment of the present solution.

According to a particular embodiment of the present solution, which is shown in FIG. 11, machine 10 may be configured to jointly perform, in a combined and integrated manner, both labelling and filling operations on containers 13, during their travel along path P.

In particular, in this embodiment, top retaining element 38 of each processing unit 25 defines a filling device 30 for filling containers 13 with a pourable product.

Filling device 80 basically comprises a support block 83 secured to the rotating frame 31 of conveyor 17, and terminating, towards the container 13, with a hollow body 84, in the example shown having a tubular configuration; filling device 80 further comprises a filling head 35 engaging hollow body 84 in a fluid-tight manner and adapted to cooperate with the top neck 15 of the container 13 to perform the filling operation.

In particular, each filling head 85 defines a filling mouth 86 and has a lower end facing the top neck 15 of the container and provided with a gasket (not shown).

Each filling head 85 is supported by the support block 83 in a rotatable manner about the relative axis, which is coaxial to the longitudinal axis A of the container 13 (and to vertical axis F of winding body 32); each filling head 85 is also supported by the support block 83 in a displaceable manner along the relative axis between a rest position (not shown), in which its lower end is spaced from the top neck 15 of the container 13, and a filling position (shown in FIG. 11), in which the gasket of its lower end is in contact with the top neck 15 of the container 13. In this filling position, the filling mouth 86 communicates with the inside of the container 13, in a fluid-tight manner with respect to the outside environment.

Displacement of filling head 85 may be controlled via an associated electrical actuator.

When filling head 35 is placed in the filling position, rotation of the winding body 32 about axis F is transmitted, through the container 13, to the same filling head 85, which is also driven to rotate about the axis F, so performing a guiding and supporting action on top neck 15 of the same container 13.

Each filling head 35 defines a central conduit 37, a first annular conduit 88 extending around the central conduit 87, and a second annular conduit 89 formed between the side wall of the filling head 85 and the outer side wall of the annular conduit 88.

Support block 83 of each filling device 80 internally defines at least three different fluid circuits, only schematically shown in FIG. 11:

- a product circuit 90 for connecting, through an ON/OFF valve (of a known type, here not shown), the annular conduit 88 to a tank (not shown) containing the pourable product;
- a pressurization circuit 91 for connecting, through an ON/OFF valve 92, the central conduit 87 to a chamber 93 filled with a pressurization fluid, e.g. carbon dioxide; and
- a decompression circuit 95 for connecting, through an ON/OFF valve 96, the annular conduit 88 to a chamber 97, in turn connected to a discharge device (not shown).

According an aspect of the discussed solution, during operation, each container 13 is rotated about its axis F, by activating electric motor 39 coupled to winding body 32, while the container 13 is filled with the pourable product by the filling device 80.

Thanks to this additional rotation of the container 13 about its axis A during the revolution movement of the same container 13 about vertical axis B (due to rotation of the carousel), the following effects may be achieved:

- the centrifugal force caused by the combined rotations generates an additional pressure on the pourable product in the container, which entraps the carbon dioxide into the product; and
- the pourable product enters into the container 13 along the lateral wall thereof, instead, of centrally.

Both these effects allow to obtain a significant reduction in the formation of foam at the end of the filling operation.

During operation of the combined filling and labelling machine 10, advantageously, labelling and filling operations may be performed substantially at a same time, thanks to the fact that containers 13 are supported, at the top surface 33 of the respective winding bodies 32, and thus may engage the respective filling device 80 during the whole operating phases (accordingly, filling operations are not impeded).

Operating phases are controlled via the respective control circuits 60 of processing units 25, based on the control signals $S_c$ received from the supervisor unit 70.

In detail, after a container 13 is received on the top surface 33 of the winding body 32 of the respective processing unit 25 at the input transfer station 18, the same container 13 is centered with respect to the filling device 80 by moving the filling head 85 from the rest position to the filling position. In particular, the gasket of the lower end of the filling head 85 contacts the top neck 15 of the container 13, which reaches a position coaxial with the filling head 85. Axis A of container 13 is coaxial wish the vertical axis of the filling head 85.

At this point, valve 92 of pressurization circuit 91 is opened (the valve of product circuit 90 and valve 96 of decompression circuit 95 are in a closed condition) and is maintained in that condition up to the moment in which pressure in the container 13 reaches a given first value $V_1$, for instance about 1.5 bar, adapted to make the container 13 sufficiently rigid for labelling. Then, the valve 92 is closed.

In the meantime, the processing unit 25 reaches second transfer station 21, where the portion 36 of labelling material is supplied to the winding body 32 from input drum 20; in order to allow winding of portion 36 about the winding body 32, the latter is rotated about its axis F by activating electric motor 39. In particular, in this phase, rotary motion is also transmitted to the container 13 and from the latter to the filling head 85, which is in contact with the top neck 15 of the same container 13 and is supported in an idle condition by support block 83.

Once the formed sleeve label 5 has been applied on container 13 (by means of the labeling phases previously discussed in detail), a further pressurization step is carried out by opening valve 92 of pressurization circuit 91, which is maintained in the open condition up to the moment in which pressure in the container 13 reaches a given second value $V_2$, for instance about 6 bar, higher than first value $V_1$ and defining the requested condition for the filling operation with carbonated liquid. Then, the valve 92 is again closed.

By opening the valve of product, circuit 93, the actual filling of the container 13 with the product can be started. This step ends when the product reaches the desired level in the container 13.

During this step, electric motor 39 is again activated, to rotate the container 13 about its axis A. Therefore, the container 13 is subjected to a revolution motion about axis B and a rotary motion about axis A, achieving the effects previously discussed.

The next step is the decompression of the container 13, which is achieved by connecting the same container 13 with decompression circuit 95. At this point, the filling head 85 can be moved back to the rest position.

In the case in which the pourable product delivered to the container 13 is a non-carbonated liquid, the second pressurization step is not performed.

The advantages of the above discussed solution are clear from the foregoing discussion.

In particular, the centralized control architecture of the labelling operations by control module 63 of processing unit 25 improves efficiency of machine 10, also providing easier maintenance and testing capabilities.

Indeed, all labelling operations are managed locally by the intelligence localised in each processing unit 25 (in the respective control, module 63), thus taking up a minimum of resources of supervising unit 70 of machine 10. The same localised management of the operations also makes each processing unit 25 testable on its own and allows to identify failures and malfunctioning in a much easier way.

Moreover, electrically-controlled displacement device 50 allows to eliminate the mechanical cam for causing relative displacement of sleeve label 5 and container 12, in order to place the formed sleeve label 5 around the same container 12.

Displacement device 50 also allows the container 13 to be held by top retaining element 36 during ail the processing operations. This in turn contributes to provide filling operations combined with labelling operations within the same machine 10 and within a same rotating path of the respective carousel.

This combined solution proves to be advantageous in terms of savings of costs, space occupation and generally improves overall efficiency of processing machine 10.

Moreover, the use of a single converting circuit for all sealing devices 45 of processing units 25, arranged at a distance with respect to the rotating part, of machine 10, allows to reduce the size and the weight of the rotating part of the same machine 10. Power supply modules 67, coupled to sealing devices 45, allow to subdivide the conversion of energy between various sealing devices 45.

Clearly, changes may be made to the solution disclosed and illustrated herein, without, however, departing from the scope of the present, invention, as defined in the appended claims.

For example, control circuit 60 of processing unit 25 may also be configured to control further elements concurring in the labelling and, possibly, the filling operations.

In particular, in the combined labelling and filling solution, control module 63 of each processing unit 25 may advantageously manage also the filling operations performed by the filling device 80, in particular the sequence and timing of the various operating phases of the same filling operations. Accordingly, labelling and filling operations may be jointly managed, by a single control module 63.

A single power supply module 67 may be configured, to supply sealing devices 45 of two or more processing units 25, e.g. having two or more output, stages under the control of a single control module 63 (the number of power supply modules 67 being lower than the number of sealing devices 45). In a further variant, a single power supply module 67, having a single output stage, may be controlled by the respective control module 63 so as to alternatively supply (in distinct time intervals) two or more sealing devices 45, which are not active at the same time for performing the welding process. Output converter of power supply module 67 is for this purpose connected electrically to heating elements 47 of such sealing devices 45 (in this case, the above sealing devices 45 are positioned at an angular distance corresponding to at least the time required for the completion of a welding process).

The invention claimed is:

1. A machine for processing containers, comprising:

a conveying device rotatable about an axis;

a plurality of processing units coupled to the conveying device for movement along a processing path, each of the processing units including:

a winding body rotatable about a longitudinal axis and configured to wind a portion of labelling material into a tubular configuration with opposite ends of the labelling material overlapped, the winding body including: a base, a top surface configured to a bottom wall of a container to be processed, and an outer lateral surface provided with a plurality of through holes for retaining the portion of labelling material by suction;

a sealing device including:

a sealing element for welding and sealing together the overlapped ends of the labelling material to form a sleeve label during movement of the processing units along the processing path, and a first actuator configured to displace the sealing element in a direction transverse to the processing path towards and away from the overlapped ends of the labelling material;

a displacement device including:

a ring-shaped platform arranged about the winding body, an arm connected to the ring platform, and a second actuator connected to the arm for moving the ring-shaped platform between a first lower position, in which the ring-shaped platform is located at the base of the winding body, and a second raised position, in which the ring-shaped platform is located at the top surface of the winding body for positioning the sleeve label at a desired portion of a container supported on the top surface; and a control circuit including:

a first driving module configured to drive the first actuator for moving the sealing device in the direction transverse to the processing path;

a second driving module configured to drive the second actuator for moving the ring-shaped platform between the first lower position and the second raised position;

a third driving module configured to activate suction through the plurality of through holes of the outer lateral surface of the winding body; and an interface module configured to receive control signals, the control signals including:

a first feedback signal indicative of displacement of the sealing element towards and away from the overlapped ends of the labelling material;

a second feedback signal indicative of the displacement device being positioned at the first lower position; and a third feedback signal indicative of the displacement device being positioned at the second raised position.

2. The machine according to claim 1, wherein the control circuit is configured to manage a timing and a sequence of processing operations performed by the sealing device and the displacement device in order to cause labelling of the container with the sleeve label.

3. The machine according to claim 2, wherein the conveying device is configured to rotate about a rotation axis, and includes an input station for feeding unlabelled containers to the conveying device and an output station for receiving from the conveying device, and for transferring at output, labelled containers, and wherein the processing path is arranged between the input and output stations.

4. The machine according to claim 2, wherein the control signals further includes a fourth feedback signal indicative of a rotation angle of the conveying device around the rotation axis, and the control circuit is configured to manage the timing and sequence of processing operations according to the rotation angle of the conveying device around the rotation axis.

5. The machine according to claim 1, wherein the winding body includes a cylindrical element having the vertical axis.

6. The machine according to claim 5, wherein the arm of the displacement device is a vertical arm, which is designed to slide within a guide, aligned to the vertical axis, the second actuator being configured to displace vertical arm along the guide, and wherein the displacement device further includes a displacement unit, carried by the vertical arm, at a free end thereof, and configured to interact with the sleeve label to cause displacement of the sleeve label.

7. The machine according to claim 6, wherein the displacement unit includes: a gripping element, coupled to the vertical arm.

8. The machine according to claim 1, wherein the control circuit is integrated in a printed circuit board, arranged in a case, which is mounted on the machine at each processing unit.

9. The machine according to claim 1, wherein the winding body is provided with a power supply module configured to provide output signals to the sealing element of the sealing device, generated starting from an input power supply signal, so as to cause heating thereof during sealing.

10. The machine according to claim 1, wherein each processing unit further includes a retaining element, configured to retain a top portion of the container to be processed, and wherein the retaining element defines a filling device, configured to fill the container with a pourable product, as the processing unit is carried along the processing path.

11. The machine according to claim 10, wherein the filling device includes a hollow supporting element, and a filling mouth for pouring the pourable product into the container, the filling mouth engaging the hollow supporting element in a rotatable manner about an axis, coaxial in use with the axis of the container, and in an axially displaceable manner between a first position, in which a lower end of the filling mouth contacts a top portion of the container, and a second position, in which the lower end of the filling mouth is spaced from the top portion of the container.

12. The machine according to claim 10, wherein each processing unit further includes a pressurization circuit for pressurizing the container before applying the label to the container, and before activating the filling device to deliver the pourable product into the container.

13. The machine according to claim 10, wherein the control circuit is configured to cause rotation of the winding body about the vertical axis, during filling of the container by the pourable product.

14. The machine according to claim 1, further comprising a supervising unit configured to provide the control circuit with control signals through a data communication bus, the control circuit being configured to control operation of the sealing device and the displacement device based on the received control signals.

15. The machine according to claim 1, wherein the functional surface of the sealing device includes a heating element configured to engage with and seal together the overlapped ends, and wherein the control circuit further includes a power supply module that is configured to provide power supply signals to the heating element so as to cause heating of the heating element during sealing.

16. The machine according to claim 15, wherein the control circuit is configured to receive:

the first feedback signal from a first sensor, the first sensor being coupled to the heating element;

the second feedback signal from a second sensor, the second sensor being coupled to the displacement device; and the third feedback signal from a third sensor, the third sensor being coupled to the displacement device.

17. The machine according to claim 16, wherein the control circuit is further configured to receive a fourth feedback signal indicating a rotational position of the conveyor about the axis.

18. The machine according to claim 1, wherein the container only moves in a circumferential direction as the container rotates about the axis along the processing path.

19. A machine for processing containers, comprising:

a conveying device rotatable about a first axis;

a plurality of processing units coupled to the conveying device for movement along a processing path, each of the processing units including:

a winding body rotatable about a longitudinal axis and configured to wind a portion of labelling material into a tubular configuration with opposite ends overlapped, the winding body including: a base, a top surface configured to a bottom wall of a container to be processed, and an outer lateral surface provided with a plurality of through holes for retaining the portion of labelling material by suction;

a sealing device including:

a sealing element for welding and sealing together the overlapped ends of the labelling material to form a sleeve label during movement of the processing units along the processing path, and a first actuator configured to displace the sealing element in a direction transverse to the processing path towards and away from the overlapped ends of the labelling material;

a displacement device including:

a ring-shaped platform arranged about the winding body, an arm connected to the ring platform, and a second actuator connected to the arm for moving the ring-shaped platform between a first lower position, in which the ring-shaped platform is located at the base of the winding body, and a second raised position, in which the ring-shaped platform is located at the top surface of the winding body for positioning the sleeve label at a desired portion of a container supported on the top surface, a retaining element configured for engaging a neck of the container to be processed, the retaining element defining a filling device for filling containers with a pourable food product, and a control circuit including:

a first driving module configured to drive the first actuator for moving the sealing device in the direction transverse to the processing path;

a second driving module configured to drive the second actuator for moving the ring-shaped platform between the first lower position and the second raised position;

a third driving module configured to activate suction through the plurality of through holes of the outer lateral surface of the winding body;

a power supply module configured to provide a power supply to the sealing element of the sealing device; and an interface module configured to receive control signals, the control signals including:

a first feedback signal indicative of displacement of the sealing element towards and away from the overlapped opposite ends of the tubular configuration of the labelling material;

a second feedback signal indicative of the displacement device being positioned at the first lower position;

a third feedback signal indicative of the displacement device being positioned at the second raised position.

20. The machine according to claim 19, wherein the container only moves in a circumferential direction as the container rotates about the axis along the processing path.

* * * * *